US007311055B2

(12) United States Patent
Peereboom et al.

(10) Patent No.: US 7,311,055 B2
(45) Date of Patent: Dec. 25, 2007

(54) VESSEL WITH DEEP WATER TRANSFER SYSTEM

(75) Inventors: Hans Peereboom, Monaco (MC); Leendert Poldervaart, La Turbie (FR); Hein Wille, Eze (FR)

(73) Assignee: Single Buoy Moorings Inc., Marly (CH)

( * ) Notice: Subject to any disclaimer, the term of this patent is extended or adjusted under 35 U.S.C. 154(b) by 130 days.

(21) Appl. No.: 10/510,135

(22) PCT Filed: Apr. 3, 2003

(86) PCT No.: PCT/EP03/03524

§ 371 (c)(1),
(2), (4) Date: Sep. 12, 2005

(87) PCT Pub. No.: WO03/082663

PCT Pub. Date: Oct. 9, 2003

(65) Prior Publication Data

US 2006/0137590 A1 Jun. 29, 2006

(30) Foreign Application Priority Data

Apr. 3, 2002 (EP) ..... 02076321

(51) Int. Cl.
*B63B 21/00* (2006.01)

(52) U.S. Cl. ..... 114/230.12

(58) Field of Classification Search ..... 114/230.12, 114/230.13; 441/3, 4, 5; 166/355; 405/210, 405/224.2, 224.3, 224.4
See application file for complete search history.

(56) References Cited

U.S. PATENT DOCUMENTS 5,823,131 A 10/1998 Boatman et al.
6,003,603 A 12/1999 Breivik et al.
6,094,937 A 8/2000 Paurola et al.
6,845,727 B2 * 1/2005 Eide et al. ..... 114/230.12

* cited by examiner

*Primary Examiner*—Lars A. Olson
(74) *Attorney, Agent, or Firm*—Young & Thompson

(57) ABSTRACT

A deep-water intake system includes a water intake duct (7) which is connected to a turret (4) of a turret-moored vessel (1). The turret (4) is used as a swivel for the large-diameter deep-water intake duct (7) while the vessel can freely weathervane around the turret.

10 Claims, 6 Drawing Sheets

VESSEL WITH DEEP WATER TRANSFER SYSTEM

Figure 1:
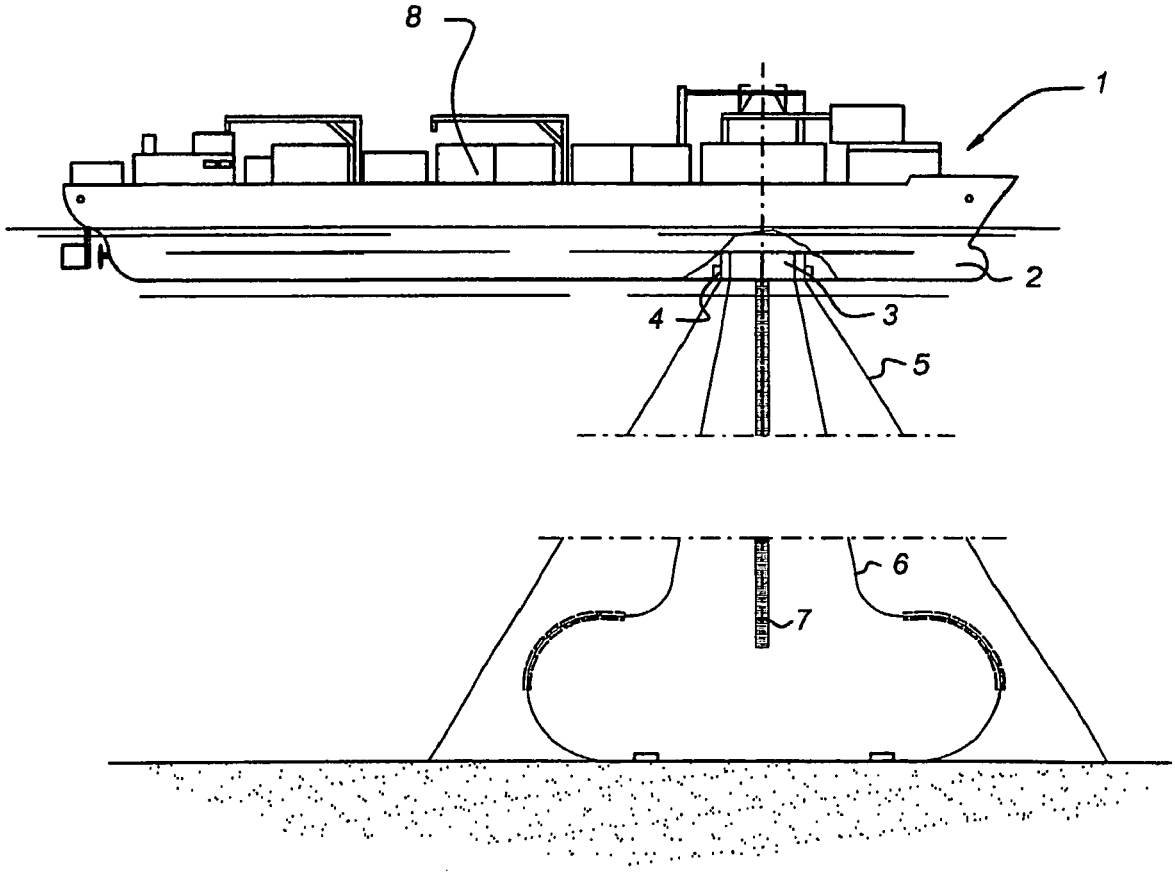

The invention relates to a turret-moored vessel comprising a hull, a cylindrical shaft in the hull having a shaft wall and a cylindrical turret with a turret wall rotatably mounted inside the shaft via at least one bearing, the turret comprising at its lower part at or near keel level anchoring lines attached to the sea bed.

For hydrocarbon production and processing, one or more product risers generally extend from the seabed to the turret, and are connected via swivels to product pipes on the vessel. When natural gas is supplied through the risers to the vessel, it is fed via swivels to processing and liquefaction units on the vessel in which the natural gas is cooled and compressed until it is liquefied. It is known to use cold seawater, which is drawn from depths of several hundreds of meters to the surface, at a temperature of for instance 4 degrees Centigrade, in the liquefaction process, by which up to 25% of the energy needed for liquefaction can be saved. The water intake pipes may have a diameter of several tens of centimeters such as 1 to 2 meters or more.

It is an object of the present invention to provide a vessel wherein large diameter pipes can be used for water intake.

It is a further object of the present invention to provide a vessel in which the large diameter pipes are used without interfering with the anchoring system of the vessel.

It is a further object of the present invention to provide a vessel which can accommodate large diameter water intake pipes without significant modifications to the vessel design.

Hereto a vessel according to the invention is characterised in that a water intake pipe extends from below sea level through the turret to an opening in the turret wall, connected to an annular water reservoir extending around the turret wall, the water reservoir being stationary with respect to the hull, a second water duct connecting the water reservoir to a cooling unit.

By using the turret as a swivel, a large diameter transfer system from the stationary turret to the wheathervaning vessel is obtained, which can accommodate water inlet pipes with a diameter of several tens of centimetres, such as 1 m or more. No significant changes to existing turret moored vessel design needs to be carried out for equipping existing turret moored vessels with a water intake system of the present invention.

Furthermore, the vertically extending water intake pipe, which extends through the turret, do does not interfere with the mooring lines and/or hydrocarbon risers extending from the seabed to a chain table and to a swivel on the turret, respectively.

In one embodiment, the second reservoir is formed by a space between the turret wall and the shaft wall, an annular sealing member bridging the space between the turret wall and the shaft wall for forming the bottom of the water reservoir.

The water reservoir is formed by the space between the turret wall and the moon-pool wall. The seal is preferably placed near lower bearings of the swivel for proper alignment and dimensional stability. The stationary water duct extends from a hole in the moon pool wall to the cooling unit, such as the LNG liquefaction plant.

The space within the turret may be used as a storage space, the bottom of the turret being closed off, openings in the turret being in fluid communication with the space between the moon pool wall and the turret wall.

In a further embodiment, the water reservoir is formed near an upper part of the swivel by a substantially box-shaped annular member, having an annular opening facing the turret wall, the water duct extending through the turret wall and projecting through the annular opening into the box-shaped reservoir.

The water reservoir needs no additional sealing means to close off the reservoir. The box-shaped annular member may form a rigid bearing support structure or "bearing box", isolating deformations of the hull from the turret support bearings.

Figure 2:
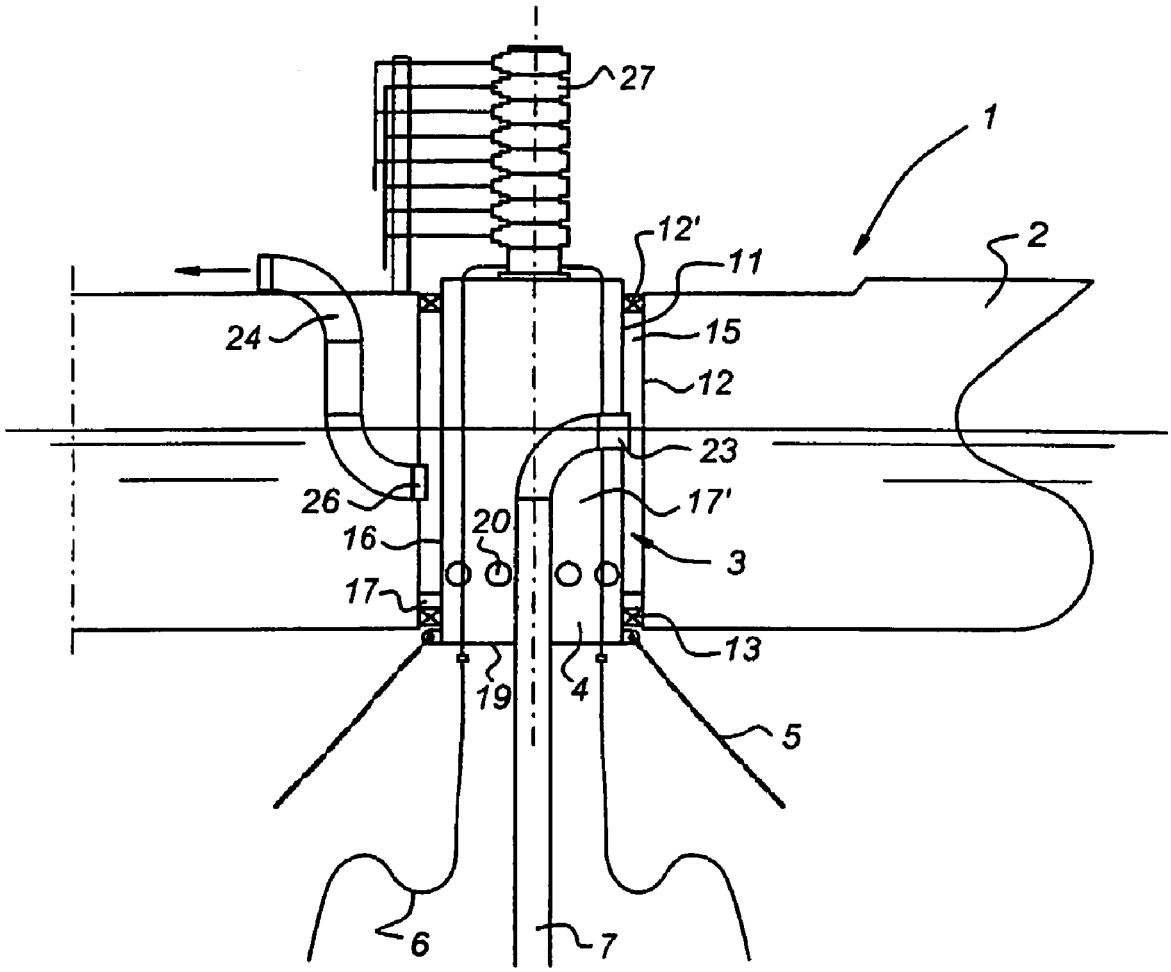
Figure 3:
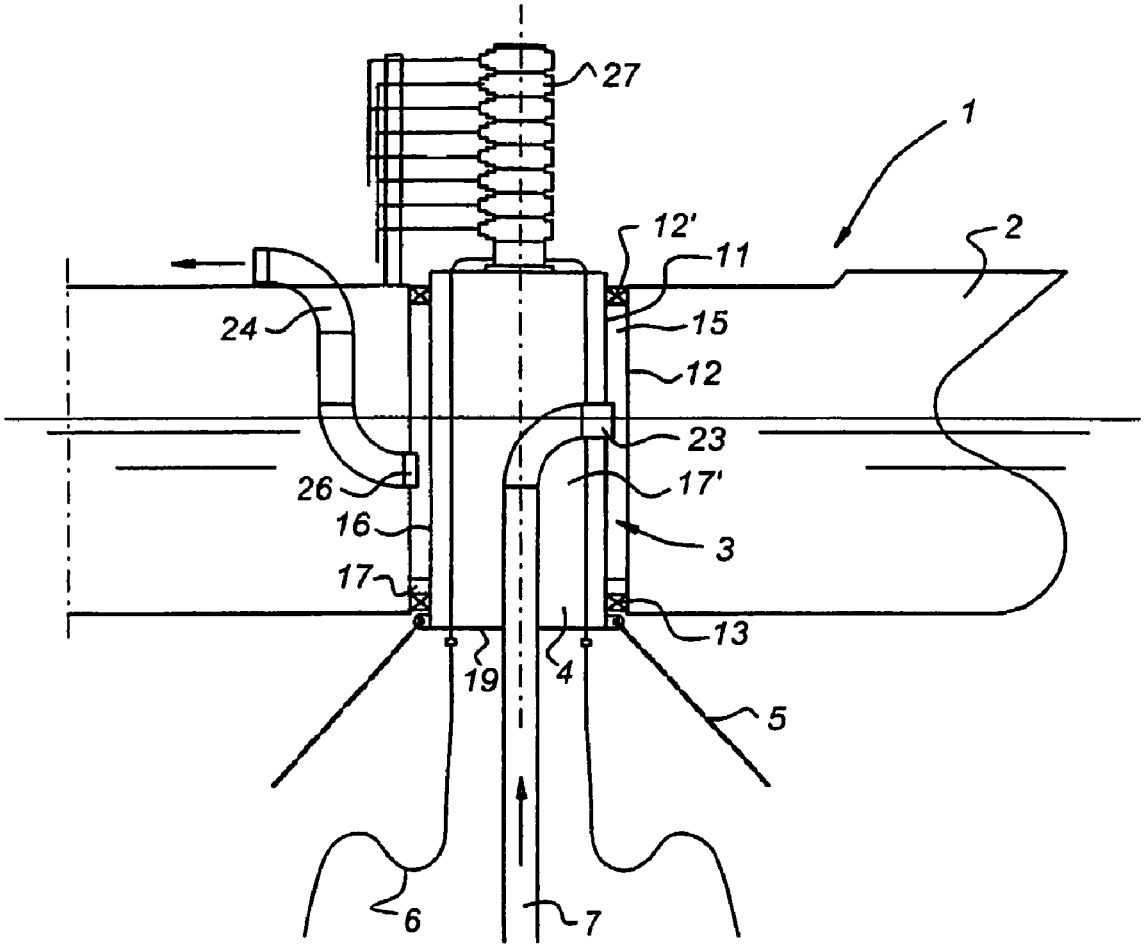
Figure 4:
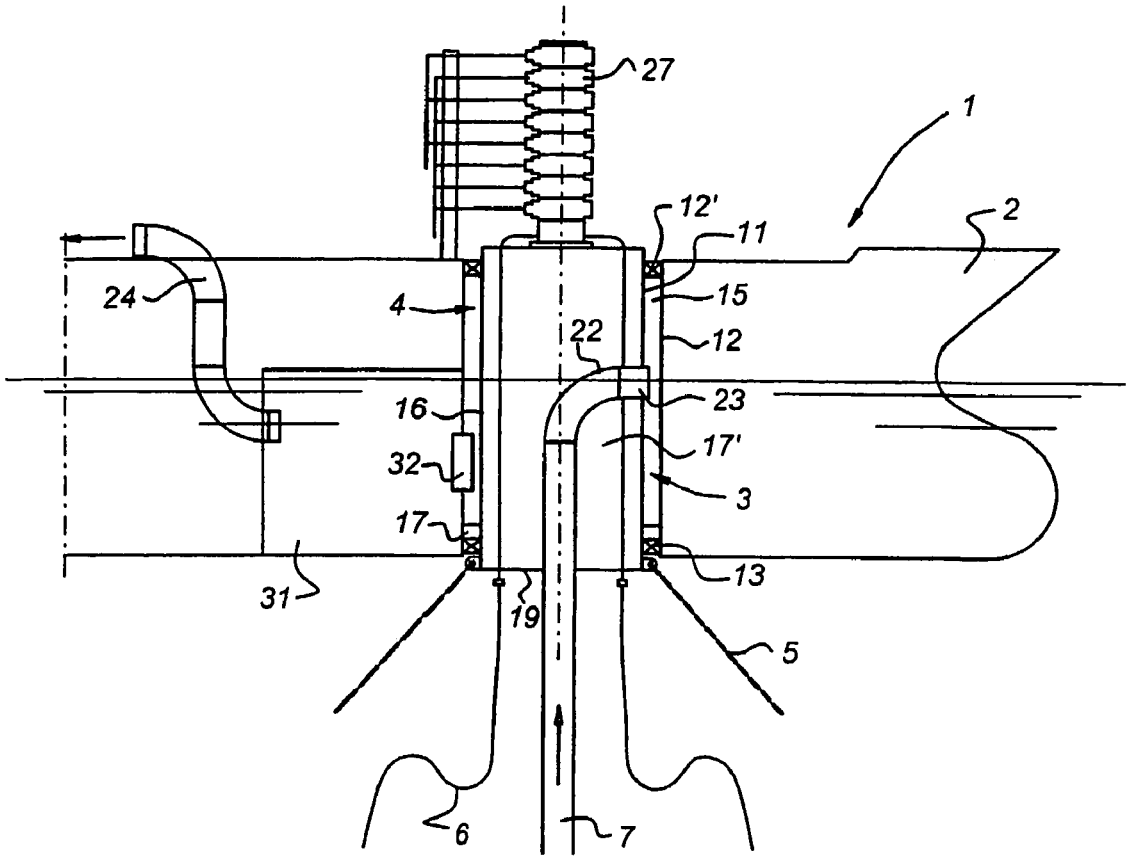
Figure 5:
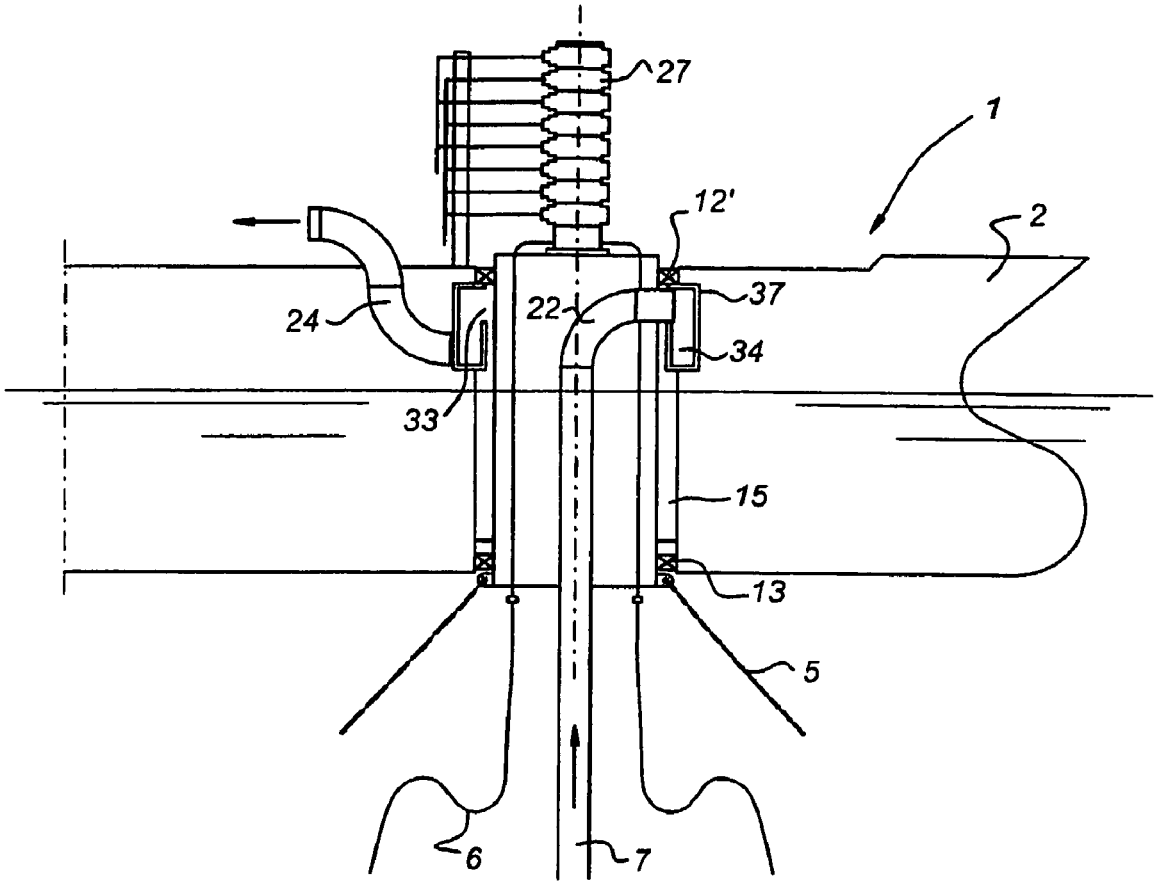
Figure 6:
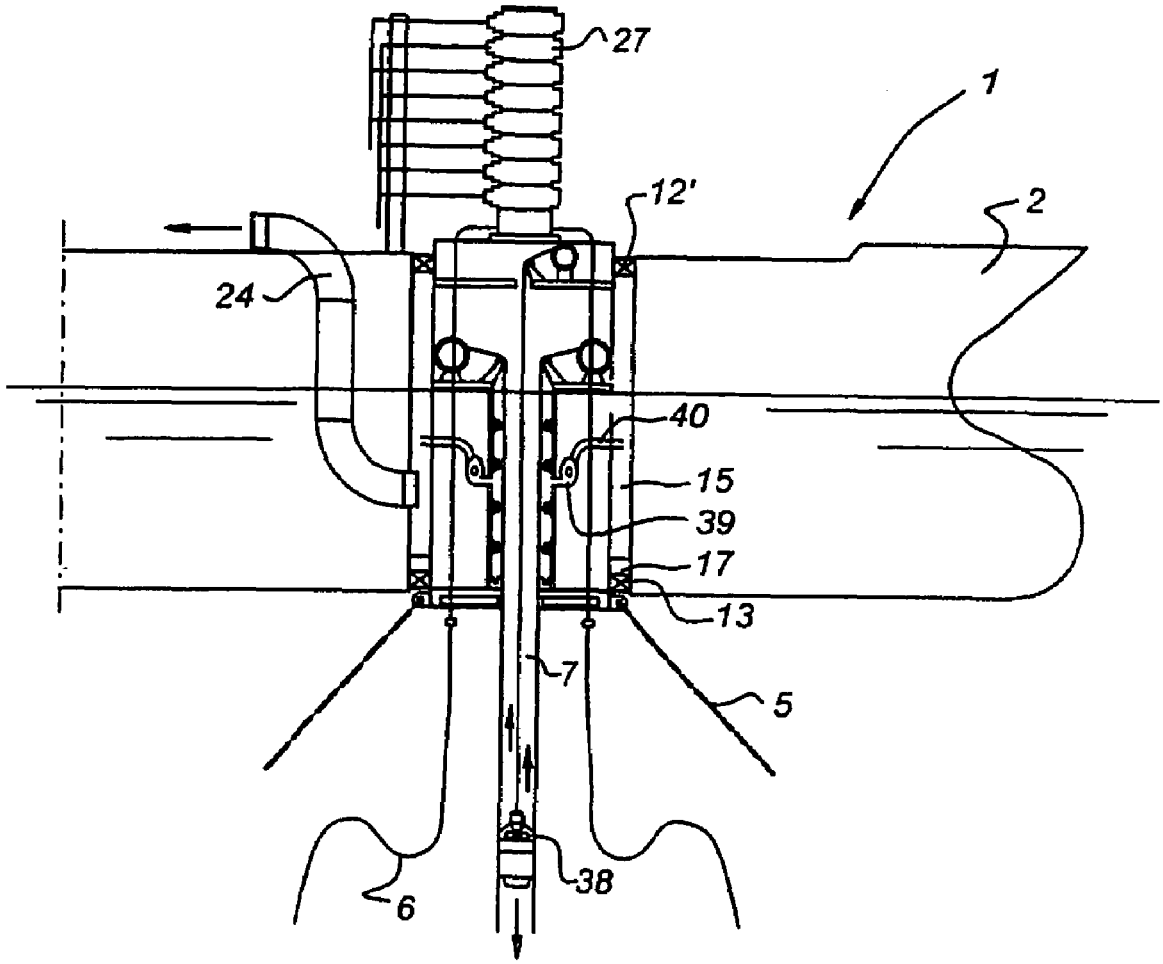

The invention will be explained in detail with reference to the accompanying drawings, in which:

FIG. 1 shows a schematic side view of a turret-moored vessel comprising a water intake duct according to the invention, FIG. 2 shows a first embodiment of a water reservoir inside the turret and in the moon pool, FIG. 3 shows a second embodiment of a water reservoir in the moon pool and sealing elements closing off the bottom of the moon pool, FIG. 4 shows an embodiment of an additional water tank connected to the reservoir in the moon pool, FIG. 5 shows an embodiment of a water reservoir at the upper end of the turret, without additional seals being required, and FIG. 6 shows a flexible deep-water duct.

In FIG. 1 a turret-moored vessel 1 is shown, comprising a hull 2 with a moon pool 3 and a turret 4. Anchor chains 5 are connected to a chain table at the lower end of the turret 4, as are hydrocarbon risers 6. The vessel 1 can weathervane around the turret 4, depending on wind and current conditions. A water inlet duct 7 extends from a large depth, such as several hundreds of meters below sea level, to the turret 4. From the turret 4, cool seawater is transported to a cooling unit on the vessel 1, such as an LNG-processing (liquefaction) plant 8. The LNG-processing plant 8 may be of the type as described in U.S. Pat. No. 5,878,814, U.S. Pat. No. 6,003,603, U.S. Pat. No. 6,324,867, which are incorporated herein by reference.

As can be seem from FIG. 2, the turret 4 comprises a cylindrical turret wall 11, located at some distance from the moon pool wall 12. The turret 4 is supported in the moon pool 3 via upper bearings 12', which may comprise axial bearings, and lower bearings 13, which may comprise radial bearings.

An annular water reservoir 15 is formed by the space enclosed by the turret wall 11 and the moon pool wall 12. Near the lower end 16 of the turret 4, an annular seal 17 closes off the bottom of the water reservoir 15. The central space 17' of the turret 4, accommodating the product risers 6, is also used as water reservoir, and has a closed bottom 19. Via openings 20 in the turret wall 11, the central space 17' is in fluid communication with the annular water reservoir 15.

The upper end 22 of the water intake duct 7 extends to an opening 23 in the turret wall 11, and supplies cool seawater into annular reservoir 15. A second duct 24 is connected to an opening 26 in the moon pool wall 12, preferably near the lower end 16 of the turret, for transport of cool seawater to a cooling unit, such as LNG processing plant 8. The hydrocarbons supplied via the risers 7, such as LNG, are transferred via swivel stack 27 on the turret, to the processing and/or storage facilities on the vessel 1.

In the embodiment of FIG. 3, the central space 17 of the turret 4 is maintained as a dry space, the cool seawater being stored in the annular space 15 only.

In the embodiment of FIG. 4, a water tank 31 is connected to the annular reservoir 15 via an opening 32. The second duct 24 extends between the cooling unit on the vessel and the water tank 31. The water tank 31 may be provided with thermally insulated walls for minimising heat transfer from the warm seawater near sea level, to the cool water in the tank, which may have a temperature of about 4 degrees Centigrade.

In the embodiment of FIG. 5, the upper end 22 of the water intake duct 7, projects through an annular opening 33 of an upper annular storage tank 37, without the space 15 being used as a water storage reservoir. In this case, the lower seals can be omitted. The storage tank 37 can function as a bearing box, and provide stiffness to the upper bearings 12, isolating deformations of the hull 2 from the bearings 12. The second duct 24 is connected to an outer wall of the tank 37.

In the embodiment of FIG. 6, a flexible water uptake duct 7 is shown such as described in U.S. Pat. No. 4,497,342 or U.S. Pat. No. 4,928,295, which are incorporated herein by reference. A pump unit 38 near the bottom of the duct, supplies water upwards from where it is pumped by pumps 39 through ducts 40, into the reservoir 15. From the reservoir 15, water is pumped through duct 24 to the cooling unit on the vessel 1.

The invention claimed is:

1. Turret-moored vessel comprising a hull, a cylindrical shaft in the hull having a shaft wall and a cylindrical turret with a turret wall rotatably mounted inside the shaft via at least one bearing, the turret comprising at its lower part at or near keel level anchoring lines attached to the sea bed, characterised in that a water intake pipe extends from below sea level through the turret via an opening in the turret wall to an annular water reservoir extending around the turret wall, the water reservoir being stationary with respect to the hull, a second water duct connecting the water reservoir to a cooling unit.

2. Turret-moored vessel according to claim 1, a second reservoir being formed by a space between the turret wall and the shaft wall, an annular sealing member bridging the space between the turret wall and the shaft wall for forming the bottom of the water reservoir.

3. Vessel according to claim 2, the bottom of the turret being closed, at least one opening being provided in the lower part of the turret wall, which opening is in fluid communication with the reservoir.

4. Vessel according to claim 1, the water reservoir being formed by a substantially box-shaped annular member, having an annular opening facing the turret wall, the water duct extending through the turret wall and projecting through the annular opening into the box-shaped reservoir.

5. Vessel according to claim 4, the box-shaped member supporting on an upper surface an upper bearing connected to the turret wall.

6. Vessel according to claim 1, a further water reservoir in the hull being placed in fluid contact with the water reservoir.

7. Vessel according to claim 1, wherein the cooling unit is part of an LNG liquefaction plant on the vessel.

8. Vessel according to claim 1, at least one hydrocarbon riser extending through the turret, to a swivel supported on the turret.

9. Vessel according to claim 1, a pump unit being supported at or near a lower end of the intake pipe.

10. Vessel according to claim 1, wherein the intake pipe has a length of at least 100 m.

* * * * *